US008230645B2

(12) United States Patent
Luca et al.

(10) Patent No.: US 8,230,645 B2
(45) Date of Patent: Jul. 31, 2012

(54) ADJUSTABLE REMOVABLE RESTRAINING STOP FOR DOUBLE HUNG WINDOWS

(76) Inventors: Alex Luca, Valley Stream, NY (US); Daniel Luca, Valley Stream, NY (US)

( * ) Notice: Subject to any disclaimer, the term of this patent is extended or adjusted under 35 U.S.C. 154(b) by 501 days.

(21) Appl. No.: 12/317,722

(22) Filed: Dec. 26, 2008

(65) Prior Publication Data

US 2009/0173012 A1 Jul. 9, 2009

Related U.S. Application Data

(60) Provisional application No. 61/009,588, filed on Dec. 28, 2007.

(51) Int. Cl.
*E05F 3/00* (2006.01)

(52) U.S. Cl. ..... 49/449; 49/450; 292/DIG. 20

(58) Field of Classification Search ..... 49/449, 49/450; 292/DIG. 20
See application file for complete search history.

(56) References Cited

U.S. PATENT DOCUMENTS

| | | | | | |
|---|---|---|---|---|---|
| 598,405 | A | * | 2/1898 | Williams | 292/339 |
| 1,601,524 | A | * | 9/1926 | Gibbons | 292/305 |
| 2,504,367 | A | | 4/1950 | Willink | |
| 2,642,121 | A | * | 6/1953 | Frick | 297/344.14 |
| 2,714,033 | A | * | 7/1955 | Lewgowd | 292/305 |
| 2,775,001 | A | | 12/1956 | Baker | |
| 3,136,290 | A | * | 6/1964 | Bailey et al. | 116/67 R |
| 3,232,655 | A | | 2/1966 | Foster | |
| 3,938,839 | A | | 2/1976 | Collier | |
| 3,967,843 | A | * | 7/1976 | Hart | 292/273 |
| 4,005,889 | A | | 2/1977 | Patrick | |
| 4,570,985 | A | * | 2/1986 | Waldo et al. | 292/262 |
| 4,593,946 | A | * | 6/1986 | Rich | 292/288 |
| 4,758,033 | A | | 7/1988 | Wolf | |
| 4,792,168 | A | * | 12/1988 | Kardosh | 292/288 |
| 4,927,198 | A | | 5/1990 | Fennell | |
| 5,125,699 | A | | 6/1992 | Dinan | |
| 5,552,768 | A | | 9/1996 | Mikiel | |
| 6,778,086 | B2 | | 8/2004 | Morrone | |
| D509,455 | S | | 9/2005 | Nordahl | |
| 2002/0157320 | A1 | * | 10/2002 | Papp | 49/449 |
| 2004/0000095 | A1 | * | 1/2004 | Smith | 49/449 |
| 2005/0151382 | A1 | | 7/2005 | Barber | |

* cited by examiner

*Primary Examiner* — Gregory J. Strimbu
(74) *Attorney, Agent, or Firm* — Alfred M. Walker

(57) ABSTRACT

An adjustable restraining stop assembly permits a residential double hung window to be locked in a partially opened position to permit ventilation through the partial opening. The stop assembly includes an outer tube with a telescoping inner tube. The outer tube is mounted to a window sash by a removable fixation device, such as a mounting hook and loop arrangement. A convenience knob is attached near the distal end of the inner tube. Adjustment is set by placing a desired hole of a plurality of holes in the telescoping inner tube in registration with a single hole in the outer tube and then inserting the end of a fastener, such as a cotter pin, locking both tubes together.

8 Claims, 3 Drawing Sheets

ADJUSTABLE REMOVABLE RESTRAINING STOP FOR DOUBLE HUNG WINDOWS

RELATED APPLICATIONS

This application is based upon provisional application Ser. No. 61/009,588 filed Dec. 28, 2007 and claims priority under 35 U.S.C. §119(e) therefrom, and is incorporated by reference herein.

FIELD OF THE INVENTION

The present invention relates to adjustable restraining stops for double hung windows which permit the window to be partially open for ventilation but locked from further opening.

BACKGROUND OF THE INVENTION

Double hung windows can be opened for ventilation from the top or bottom. While most windows have locks which are operable when the windows are closed, a partially open window is often left without recourse to locking. Some windows have built-in restraints to permit locking to prevent opening more than a certain fixed amount. Auxiliary screw operated locks which must be screwed into window frames are also well known, but rental apartments often disallow such modifications. An adhesively-mounted removable retrofit adjustable restraining stop for double hung windows is not known in the prior art.

OBJECTS OF THE INVENTION

It is therefore an object of the present invention to provide an adjustable restraining stops for double hung windows which permit the window to be partially open for ventilation but locked from further opening.

It is also an object of the present invention to provide a window stop which does not need to physically alter the window frame.

Other objects which become apparent from the following description of the present invention.

SUMMARY OF THE INVENTION

In keeping with these objects and others which may become apparent, the present invention provides an adjustable removable restraining stop for double hung windows in the form of a telescoping assembly that can be adjusted in steps to restrain a window from opening beyond a desired extent. The assembly itself is attached to the window via a large-area robust hook and loop pad with the hook portion conveniently attached to the window or sash frame via a pressure sensitive adhesive layer that is exposed upon peeling off a release liner layer. As such, the assembly can be removed to permit unencumbered opening of the window and replaced whenever the security feature is desired. Hook and loop pads of several square inches of area and of aggressive design have sufficient shear resistance to provide the desired degree of security in this application, but the two mating surfaces can still be peeled by twisting. No tools whatsoever are required for installation. The telescoping sections include a larger rectangular or square tubing section that is attached via the hook and loop pad, and a close-fitting inner tube of smaller dimension that telescopes from one end of the larger tubular section with some frictional resistance. Although the preferred material is polyvinylchloride (PVC), other materials such as aluminum can be used. The inner tube has a series of holes in a linear array on the front surface (opposite the mounting pad), while the outer tube has a single hole adjacent its end that is in registration with any in the series of holes as the inner tube is pushed in or out. A cotter pin on a short lanyard is used to lock in the desired assembly length by passing it through the single hole in the larger outer tube and then through one of the holes in the inner tube.

By attaching the assembly to the frame of the top window sash near the top, a constrained opening can be adjusted at the top of the window, the bottom, or the open space can be shared as desired between top and bottom.

In an alternate embodiment, the hole in the outer tube as well as the series of holes in the inner tube are moved to the side surface to afford more clearance for a ring-grip quick release pin to go through the assembly on the distal side. The ring-grip quick release pin is used instead of the cotter pin of the first embodiment to provide a locking member and the security of going entirely through both telescoping tubes. It provides a more positive locking feel and more convenient grip.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
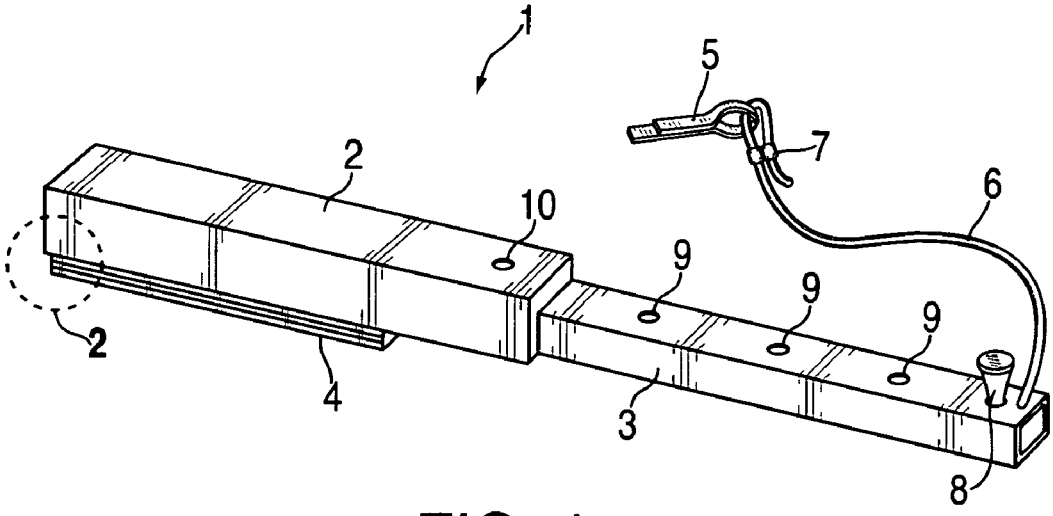
FIG. 1 is a perspective view of the adjustable restraining stop assembly of this invention.
Figure 2:
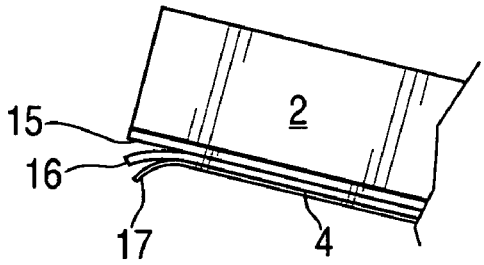
FIG. 2 is a side view detail showing the hook and loop layers used for mounting.

FIG. 1 shows adjustable restraining stop assembly 1 with outer tube 2, inner tube 3, and mounting hook and loop layer 4. A convenience knob 8 is attached near the distal end of inner tube 3. Adjustment is set by placing one of holes 9 on the front surface of inner tube 3 in registration with hole 10 on tube 2 and then inserting cotter pin 5 through hole 10 and into the desired hole 9 thereby locking the two tubes together. A lanyard line 6 is used to prevent losing cotter pin 5; it is retained in cotter pin 5 by using compression sleeve 7 to form a loop splice. FIG. 2 shows the various layers of the hook and loop layer 4. As supplied by the factory, the loop layer 15 is already bonded to tube 2. Layers 16 and 17, the hook layer and its release liner respectively, are also attached. To attach the assembly to the sash frame, the user must only remove release liner 17 exposing the layer of pressure sensitive adhesive and then just press assembly 1 against the window sash frame as shown in FIG. 3.

Figure 3:
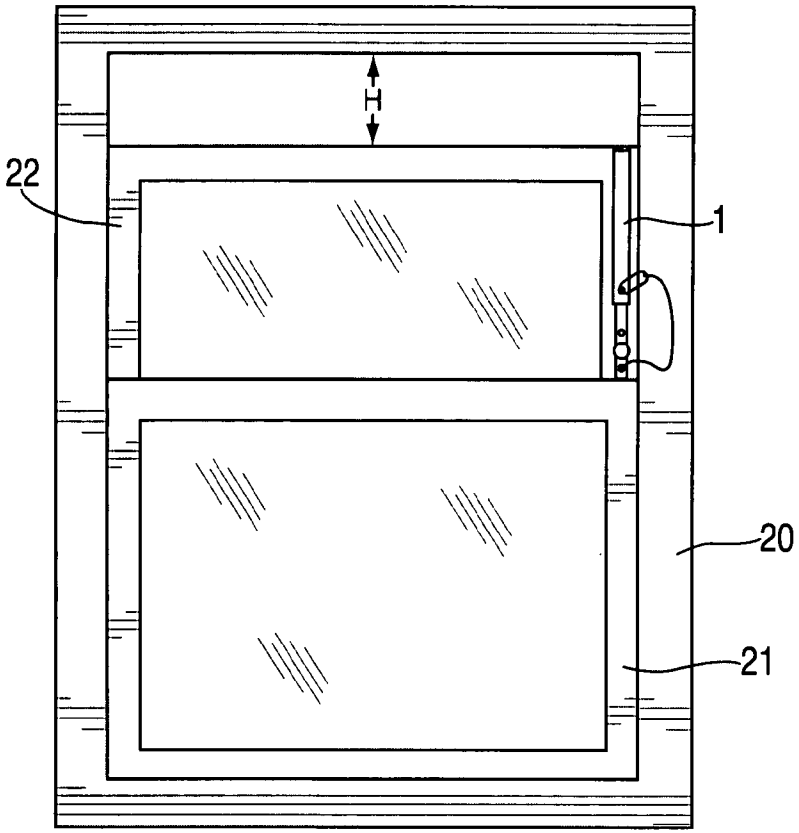
FIG. 3 is a front elevation of the assembly of FIG. 1 installed on a double hung window showing the open region at the top.
Figure 3A:
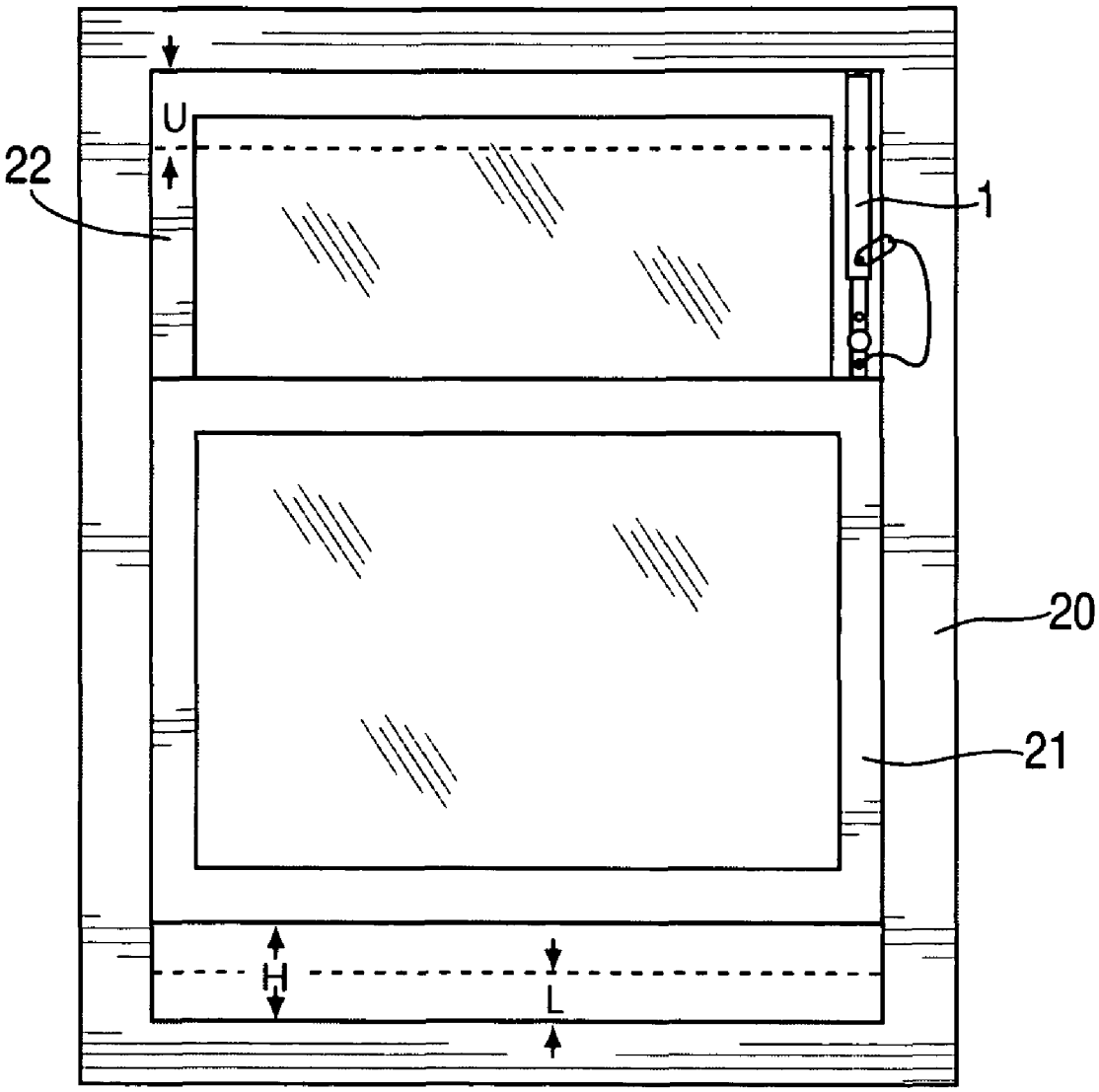
FIG. 3A is a front elevation of the same window and assembly as in FIG. 3, but the open region is now shown at the bottom; dashed lines indicate an alternate intermediate position.

FIG. 3 shows window frame 20 with upper sash 22 and lower window sash 21. Assembly 1 is set at a desired position and locked. As shown, upper sash 22 is limited to an opening height of H, however the entire two-sash assembly can be moved upward any distance up to H to provide some ventilation at the bottom of the window. FIG. 3A shows the same window with assembly 1 at the same setting, but the open region (height H) is now at the bottom of window frame 20. Two dashed lines, one near the top of frame 20 and one near the bottom illustrate an alternate intermediate position with open regions both at the top and bottom. Lower open region height L and upper open region height U are related such that L+U=H if the setting of assembly 1 is unchanged.

Figure 4:
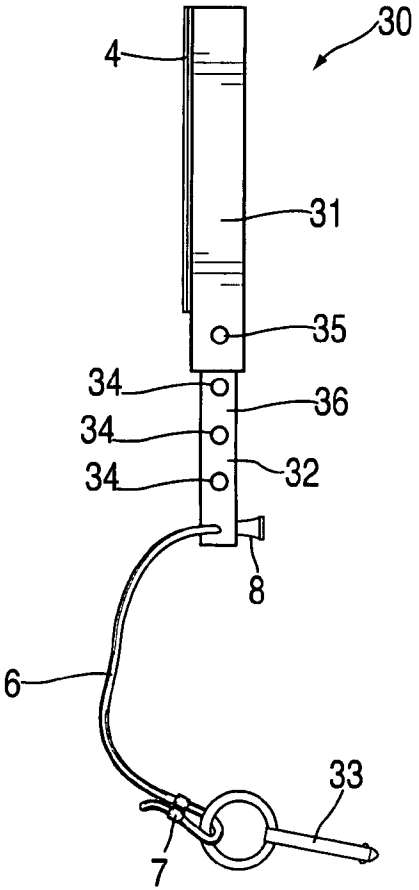
FIG. 4 is a side view of an alternate embodiment restraining stop assembly using a ring-grip quick release pin.

An alternate embodiment adjustable restraining stop 30 is shown in FIG. 4. Here the adjustment holes 34 on inner tube 32 as well as matching hole 35 in outer tube 31 have been moved to the side. Also, adjustment holes 34 on tube 32 and hole 35 in tube 31 are now through holes penetrating both proximal and distal surfaces of the tubes. This permits ring-grip quick release pin 33 to pass entirely through the assembly with enough clearance at the distal end for the front locking balls. Since it may be more problematic to align one of holes 34 with hole 35 with the side position, line indicia on surface 36 on the front of tube 32 align with the bottom end of tube 31 to indicate registration positions.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

We claim:

1. An adjustable window stop assembly which locks sashes of a double hung window together to permit ventilation through the window said stop assembly:

an outer tube in combination with a telescoping inner tube, said telescoping inner tube telescopically slidable within said outer tube;

said outer tube and said telescoping inner tube each having a quadrilateral cross section;

said stop assembly also including a hook and loop fastening pad with a loop layer thereof bonded to said outer tube and a hook layer thereof having a releasable adhesive adhering said hook layer to a selected exposed surface of an upper one of said sashes of said double hung window, the outer tube being attached to said selected exposed surface via said hook and look fastening pad;

an upper end of said outer tube being substantially aligned with an upper edge of the upper sash whereby said sashes, when locked together, can be adjusted to create an upper or lower opening in said double hung window;

said telescoping inner tube removably resting at a bottom edge thereof on a top surface of a lower one of said sashes, whereby said stop assembly including said hook and loop fastening pad is removable from said double hung window;

a knob being attached to said inner tube adjacent said bottom edge of said telescoping inner tube;

a single hole in said outer tube being aligned with a row of holes in said telescoping inner tube;

a fastener comprising a pin; and a lanyard having one end attached to said fastener and an opposite end attached to said inner tube at a point adjacent the bottom edge of the inner tube and said knob;

a length of said window stop assembly and a size of said opening in said double hung window are adjusted by placing a selected one of said holes of the row of holes in said telescoping inner tube in alignment with said single hole in said outer tube and then inserting said pin through said single hole of said outer tube and into said selected hole in said telescoping inner tube.

2. The adjustable window stop assembly as recited in claim 1 wherein said telescoping inner tube and said outer tube are plastic.

3. The adjustable window stop assembly as recited in claim 2 wherein said plastic is polyvinylchloride.

4. The adjustable window stop assembly as recited in claim 1 wherein said telescoping inner tube and said outer tube are metal.

5. The adjustable window stop assembly as recited in claim 4 wherein said metal is aluminum.

6. The adjustable window stop assembly as recited in claim 1 wherein said row of holes is on a front surface of said inner tube.

7. The adjustable window stop assembly as recited in claim 1 wherein said row of holes is in a side surface of said inner tube;

said single hole is in a side surface of said outer tube, and all of said holes are through holes penetrating both proximal and distal surfaces of a respective one of said telescoping inner tube and said outer tube.

8. The adjustable window stop assembly as recited in claim 1 wherein said pin is a quick release pin having locking balls.

* * * * *